US011241700B2

(12) United States Patent
Fernald et al.

(10) Patent No.: US 11,241,700 B2
(45) Date of Patent: Feb. 8, 2022

(54) NON-FLOTATION BASED RECOVERY OF MINERAL BEARING ORE USING HYDROPHOBIC PARTICLE COLLECTION IN A PIPELINE SECTION

(71) Applicant: CiDRA Corporate Services LLC, Wallingford, CT (US)

(72) Inventors: Mark R. Fernald, Enfield, CT (US); Paul J. Rothman, Windsor, CT (US); Alan D. Kersey, South Glastonbury, CT (US)

(73) Assignee: CIDRA CORPORATE SERVICES, INC., Wallingford, CT (US)

( * ) Notice: Subject to any disclaimer, the term of this patent is extended or adjusted under 35 U.S.C. 154(b) by 98 days.

(21) Appl. No.: 16/339,836

(22) PCT Filed: Oct. 10, 2017

(86) PCT No.: PCT/US2017/055836

§ 371 (c)(1),
(2) Date: Apr. 5, 2019

(87) PCT Pub. No.: WO2018/068049

PCT Pub. Date: Apr. 12, 2018

(65) Prior Publication Data

US 2019/0291121 A1 Sep. 26, 2019

Related U.S. Application Data

(60) Provisional application No. 62/405,569, filed on Oct. 7, 2016, provisional application No. 62/405,303, filed on Oct. 7, 2016.

(51) Int. Cl.
*B03D 1/14* (2006.01)
*B03D 1/016* (2006.01)
(Continued)

(52) U.S. Cl.
CPC ..... *B03D 1/016* (2013.01); *B03D 1/02* (2013.01); *B03D 1/023* (2013.01); *B03D 1/14* (2013.01);
(Continued)

(58) Field of Classification Search
CPC ..... B03D 1/023; B03D 1/016; B03D 1/1456; B03D 1/02; B03D 1/14; B03D 2201/02; B03D 2203/02; B03C 1/01; B03C 1/30
(Continued)

(56) References Cited

U.S. PATENT DOCUMENTS 6,896,808 B1 5/2005 Jay
9,302,270 B2 4/2016 Rothman et al.
(Continued)

FOREIGN PATENT DOCUMENTS

WO 2012162591 A1 11/2012
WO 2012162593 A2 11/2012
(Continued)

*Primary Examiner* — Thomas M Lithgow
(74) *Attorney, Agent, or Firm* — Ware, Fressola, Maguire & Barber LLP

(57) ABSTRACT

Apparatus uses hydrophobic synthetic beads to recover mineral particles in a slurry. The synthetic beads and the slurry are mixed into a mixture for processing. The apparatus has an interaction vessel installed in a section of pipeline. The interaction vessel is made from a pipeline folded or coiled into a compact struction having a continuous flow path. The interaction vessel has an input to receive the mixture of slurry and synthetic beads. The folded or coiled structure is used to increase the residence time of the mixture in the flow path, allowing more time for the mineral particles in the slurry to attach to the surface of the synthetic bead, while maintaining a small footprint. The interaction
(Continued)

vessel may be formed from a number of loops of pipe section. The interaction vessel may be formed from one or more folded structures.

17 Claims, 9 Drawing Sheets

(51) Int. Cl.
*B03D 1/02* (2006.01)
*B03C 1/01* (2006.01)
*B03C 1/30* (2006.01)

(52) U.S. Cl.
CPC ..... *B03D 1/1456* (2013.01); *B03C 1/01* (2013.01); *B03C 1/30* (2013.01); *B03D 2201/02* (2013.01); *B03D 2203/02* (2013.01)

(58) Field of Classification Search
USPC ..... 209/168, 4, 5, 9
See application file for complete search history.

(56) References Cited

U.S. PATENT DOCUMENTS

2010/0147766 A1 6/2010 Nissen et al.
2012/0168385 A1* 7/2012 Anderson ..... C02F 9/00 210/703
2014/0183104 A1* 7/2014 Rothman ..... B01D 37/02 209/168

FOREIGN PATENT DOCUMENTS

WO 2012162614 A1 11/2012
WO 2018067642 A1 4/2018
WO 2018067649 A1 4/2018

* cited by examiner

NON-FLOTATION BASED RECOVERY OF MINERAL BEARING ORE USING HYDROPHOBIC PARTICLE COLLECTION IN A PIPELINE SECTION

CROSS-REFERENCE TO RELATED APPLICATIONS

This application corresponds to international patent application no. PCT/US17/55836, filed 10 Oct. 2017, which claims the benefit of U.S. Provisional Application No. 62/405,303 (712-2.438 (CCS-0168), filed 7 Oct. 2016, having a similar title, as well as U.S. Provisional Application No. 62/405,569 (712-2.439 (CCS-0175)), entitled "Three Dimensional Functionalized Open-Network Structure for Selective Separation of Mineral Particles in an Aqueous System", filed 7 Oct. 2016, which are all incorporated by reference herein in their entirety.

BACKGROUND OF THE INVENTION

1. Technical Field

This invention relates generally to a method and apparatus for separating valuable material from unwanted material in a mixture, such as a pulp slurry, or for processing mineral product for the recovery of minerals in a mineral extraction process.

2. Description of Related Art

In many industrial processes, flotation is used to separate valuable or desired material from unwanted material. By way of example, in this process a mixture of water, valuable material, unwanted material, chemicals and air is placed into a flotation cell. The chemicals are used to make the desired material hydrophobic and the air is used to carry the material to the surface of the flotation cell. When the hydrophobic material and the air bubbles collide they become attached to each other. The bubble rises to the surface carrying the desired material with it.

The performance of the flotation cell is dependent on the bubble surface area flux in the collection zone of the cell. The bubble surface area flux is dependent on the size of the bubbles and the air injection rate. Controlling the bubble surface area flux has traditionally been very difficult. This is a multivariable control problem and there are no dependable real time feedback mechanisms to use for control.

Flotation processing techniques for the separation of materials are a widely utilized technology, particularly in the fields of minerals recovery, industrial waste water treatment, and paper recycling for example.

By way of example, in the case of minerals separation the mineral bearing ore may be crushed and ground to a size, typically around 150 microns or less, such that a high degree of liberation occurs between the ore minerals and the gangue (waste) material. In the case of copper mineral extraction as an example, the ground ore is then wet, suspended in a slurry, or 'pulp', and mixed with reagents such as xanthates or other reagents, which render the copper sulfide particles hydrophobic.

Froth flotation is a process widely used for separating the valuable minerals from gangue. Flotation works by taking advantage of differences in the hydrophobicity of the mineral-bearing ore particles and the waste gangue. In this process, the pulp slurry of hydrophobic particles and hydrophilic particles is introduced to a water filled tank containing surfactant/frother which is aerated, creating bubbles. The hydrophobic particles attach to the air bubbles, which rise to the surface, forming a froth. The froth is removed and the concentrate is further refined.

Standard flotation has a number of limitations:

- Due to the natural dynamics of the bubbles, a mineral-bearing particle may not typically be carried to the surface on one bubble, but may have to attach, be detached and re-attach to several bubbles to reach the froth layer.
  - Larger particles containing minerals may not be lifted due to the limited buoyancy of a bubble, and the attractive forces between the bubble and the ore particle (created by the collector/hydrophobic chemical additives)

In general, 10% to 15% of the mineral bearing ore in the pulp is not recovered using air-based flotation processes, and consequently, new separation technologies are being explored and developed.

The present invention provides a method and apparatus for the improved recovery of the minerals in a pulp slurry or in the tailings.

SUMMARY OF THE INVENTION

The present invention offers a solution to the above limitations of traditional mineral beneficiation. According to various embodiments of the present invention, minerals in a pulp slurry or in the tailings stream in a mineral extraction process, are recovered by applying engineered recovery media (as disclosed in commonly owned family of cases set forth below, e.g., including PCT application no. PCT/US12/39540, entitled "Mineral separation using Sized-, Weight- or Magnetic-Based Polymer Bubbles or Bead", and PCT application no. PCT/US16/62242, entitled "Utilizing Engineered Media for Recovery of Minerals in Tailings Stream at the End of a Flotation Separation Process") in accordance with the present invention. The process and technology of the present invention circumvents the performance limiting aspects of the standard flotation process and extends overall recovery. The engineered recovery media (also referred to as engineered collection media, collection media or barren media) obtains higher recovery performance by allowing independent optimization of key recovery attributes which is not possible with the standard air bubble in conventional flotation separation.

In particular, the method and apparatus for the recovery of minerals uses engineered recovery media to attract the minerals and to cause the mineral particles to attach to the surfaces of the engineered recovery media. The engineered recovery media are also herein referred to as engineered collection media, mineral collection media, collection media or barren media. The term "engineered media" refers to synthetic bubbles or beads or polymer shells, typically made of a polymeric base material and coated with a hydrophobic material. In other words, the polymeric base material is modified to make the surface of the polymer attractive to the mineral of interest—either through hydrophobic attraction, or other chemical linkage to the collectors on the mineral particles. In this process, minerals attach to the polymer shells and separation is achieved via flotation of these 'engineered bubbles'. This approach/system exhibits a higher degree of robustness than conventional air-bubble flotation. Alternatively, the polymer is used to form, or coat plates, or belts, in which case the mineral particles adhere to the surfaces, and on removal from a cell, the bound mineral can be washed off (with the release being chemically triggered—e.g., pH for example), or mechanically released (e.g., vibration/ultrasonically for example).

According to some embodiments, and by way of example, the synthetic bubbles or beads may have a substantially spherical or cubic shape, consistent with that set forth herein, although the scope of the invention is not intended to be limited to any particular type or kind of geometric shape. The term "loaded", when used in conjunction with the collection media, means having mineral particles attached to the surface and the term "unloaded" means having mineral particles stripped from the surface.

One important parameter in standard flotation, and specialized flotation (such as fluidized bed systems) and the engineered bubbles approach is "residence time". This is the time required to maintain particles in a flotation cell to efficiently allow the mineral bearing ore particles to interact sufficiently with the air bubbles and become attached and thus recovered through the flotation process. This is a very probability-driven process; e.g. the probability of particle-bubble contact, particle-bubble attachment, transport between the pulp and the froth, and froth collection into the product launder.

Consequently, in most flotation systems, several cells are used in series to increase the total "particle residence time", thus increasing the probability of contact between mineral bearing ore particles and the bubbles in the cells.

The present invention provides a method and an apparatus for the recovery of the minerals in the pulp slurry and the minerals present in the tailings using engineered collection media that can be designed with varying specific gravities. This freedom allows new processing cell design wherein the collection media do not necessarily reach the top of the cell to form a froth layer.

Thus, the first aspect of the present invention is an apparatus, comprising:

a fluid conduit arranged to receive a mixture of slurry and a plurality of synthetic beads, the slurry comprising mineral particles and undesirable ore material, the fluid conduit also arranged to discharge enriched synthetic beads having mineral particles attached thereon, the synthetic beads having a surface functionalized with a hydrophobic material, wherein at least part of the fluid conduit is shaped into an interaction vessel, the interaction vessel having a first vessel end end and a second vessel end, and wherein a distance between the first vessel end and the second vessel end is at least 6 times smaller than a fluid path in the fluid conduit in the interaction vessel.

According to an embodiment of the present invention, the part of fluid conduit is coiled into a plurality of loops, said plurality of loops comprises n loop, with n being a positive number greater 2, but n can be 8 or greater.

According to an embodiment of the present invention, the plurality of loops comprises continuous loops placed one on top of another, and the loops can be circular or elliptical.

According to an embodiment of the present invention, each of the circular loops has a diameter substantially equal to the distance between the first vessel end and the second vessel end.

According to an embodiment of the present invention, each of the elliptical loops has a semi-miner axis and a semi-major axis, the semi-major axis is substantially equal to half of the distance between the first vessel end and the second vessel end.

According to an embodiment of the present invention, the part of fluid conduit is folded into n folded structures, each folded structure comprising m conduit segments interconnected to provide a continuous path therein, each conduit segment having a segment length substantially equal to the the distance between the first vessel end and the second vessel end, wherein n and m are positive numbers with n×m being greater than 6, wherein n is equal to 10 or greater, and m is equal to 10 or greater.

According to an embodiment of the present invention, at least some of the conduit segments comprises a path extending structure therein for increasing the fluid path in the conduit segment.

According to an embodiment of the present invention, the apparatus further comprises:

a first input arranged to receive the slurry;

a second input arranged to receive the synthetic beads, and an output arranged to provide the mixture of the slurry and synthetic beads to the first conduit end of the fluid conduit.

According to an embodiment of the present invention, the second conduit end is further arranged to discharge the undesirable ore material in the slurry, said apparatus further comprising a separation device, the separation device having an input, a first output and a second output, the input arranged to receive a mixed material comprising the enriched synthetic beads having mineral particles attached thereon and the undesirable ore material, the separation device configured to separate the mixed material into a first separated part and a second separation part, wherein the first output is arranged to discharge the first separated part and the second output arranged to discharge the second separated part, wherein the first separated part comprises the enriched synthetic beads having mineral particles attached thereon, and the second separated part comprises the undesirable ore material.

According to an embodiment of the present invention, the synthetic beads are buoyant as to water, and wherein the separation device comprises a flotation chamber having a lower part and an upper part, the lower part arranged to receive the mixed material and the upper part arranged to gather the enriched synthetic beads having mineral particles attached thereon for providing the first separated part.

According to an embodiment of the present invention, the hydrophobic material is selected from the group consisting of polysiloxanes, poly(dimethylsiloxane), hydrophobically-modified ethyl hydroxyethyl cellulose, polysiloxanates, alkylsilane and fluoroalkylsilane.

According to an embodiment of the present invention, the synthetic bubbles or beads are made of an open-cell foam. The synthetic bubbles or beads can have a substantially spherical shape or a substantially cubic shape.

The second aspect of the present invention is a method, comprising:

receiving in a fluid conduit a mixture comprising a slurry and a plurality of hydrophobic synthetic beads, the slurry comprising mineral particles arranging at least a part of the fluid conduit into a compact structure having a continuous fluid path;

allowing the mineral particles to attach to the hydrophobic synthetic beads at least in the compact structure to form enriched synthetic beads in the fluid path; and discharging from the coiled or folded structure the enriched synthetic beads.

According to an embodiment of the present invention, the compact structure comprises a plurality of loops interconnected to provide the continuous fluid path.

According to an embodiment of the present invention, the compact structure comprises a plurality of pipe segments interconnected to form a folded structure to provide the continuous fluid path.

DETAILED DESCRIPTION OF THE INVENTION

FIGS. 1, 2, 3, 4, 4A and 4B

The apparatus or enhanced processing system, according to an embodiment of the present invention has an "interaction vessel" configured to hold a mixture comprising engineered collection media and a pulp slurry or slurry. The slurry contains mineral particles and undesirable ore material, which is also referred to as ore residue or tails at certain processing stages. The interaction vessel is arranged to install in a pipeline section after slurry and engineered collection media are received in a media mixer. The interaction vessel has a continous fluid conduit or pipeline coiled, folded or otherwise shaped into a compact structure having a small footprint. The lengthy path within the conduit in the interaction vessel allows the mineral particles in the slurry to have a long residence time to attach to the engineered collection media. The engineered collection media having mineral particles attached thereon are referred to as enriched engineered collection media or enriched synthetic beads. The enriched engineered collection media, along with undesirable ore material in the slurry, are then discharged from the interaction vessel to the next processing stage. In the next processing stage, the undesirable ore material is discharged as tails, and the enriched engineered collection media are further processed to separate the mineral particles from the engineered collection media. The engineered collection media are washed or cleaned for reused.

The engineered collection media, according to the present invention, are also referred to as synthetic beads, barren media, etc. The enriched engineered collection media are also referred to as mineral laden media, loaded media. The engineered collection media has a surface functionalized to be hydrophobic. The engineered collection media can have a body made of a polymer and the body may have a different shape such as spherical and rectangular. The surface may have surface structure to trap the mineral particles or to increase the surface area to attract mineral particles. Part or entire body of the engineered collection media may be porous or made of an open-cell foam. Enriched engineered collection media and various barren media are shown in FIGS. 5*a* to 7*d*.

Figure 1:
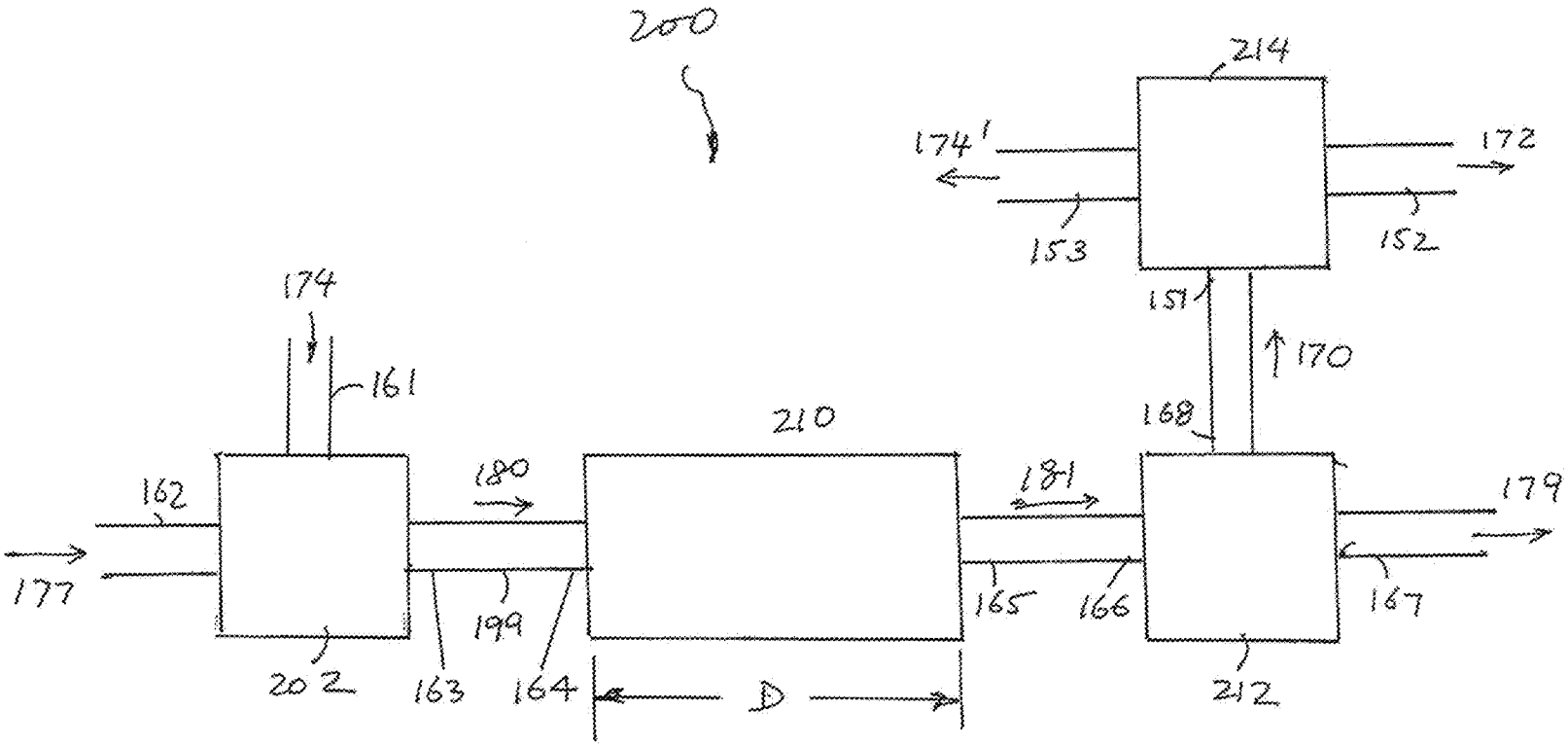
FIG. 1 illustrates an apparatus with an interaction vessel, according to an embodiment of the present invention.
Figure 3:
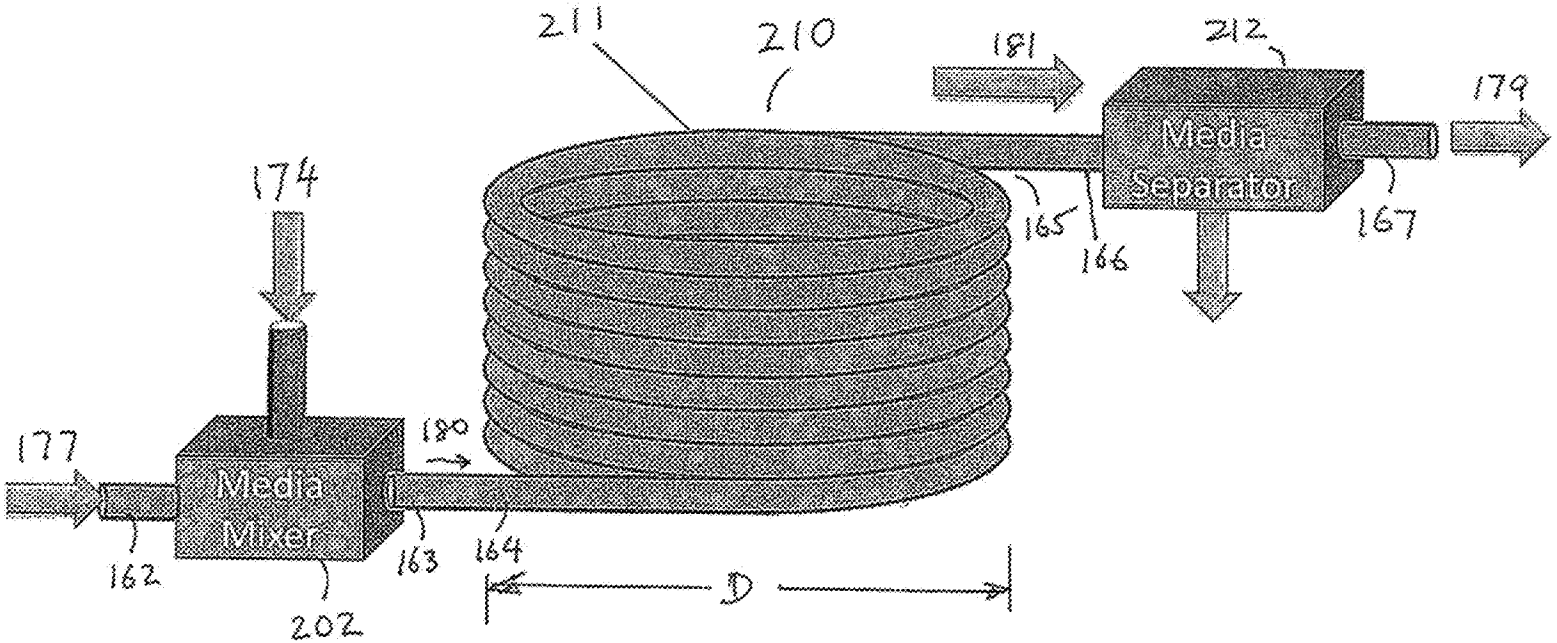
FIG. 3 illustrates an interaction vessel, according to an embodiment of the present invention.
Figure 4:
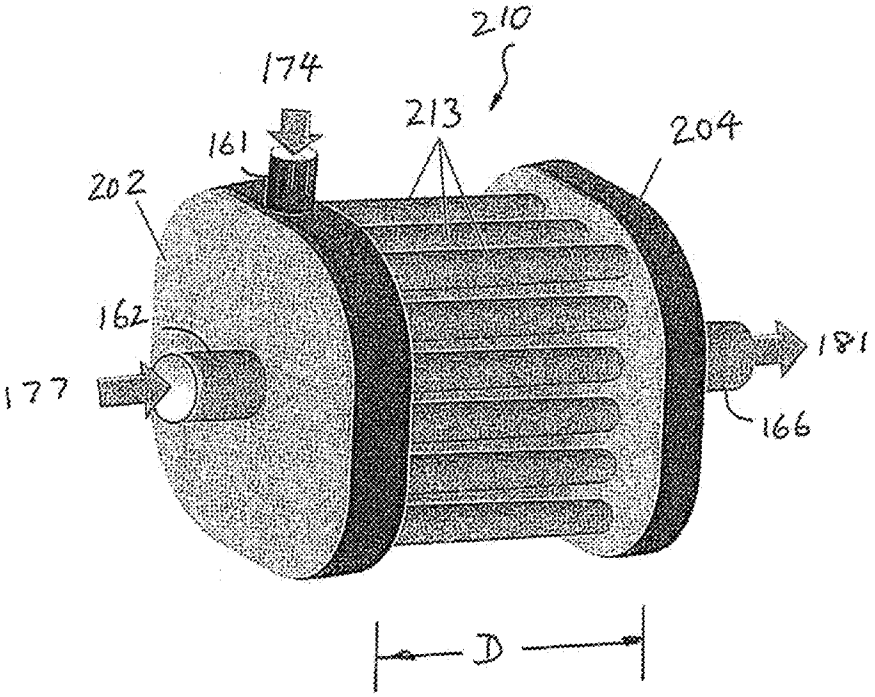
FIG. 4 illustrates an interaction vessel, according to another embodiment of the present invention.
Figure 4A:
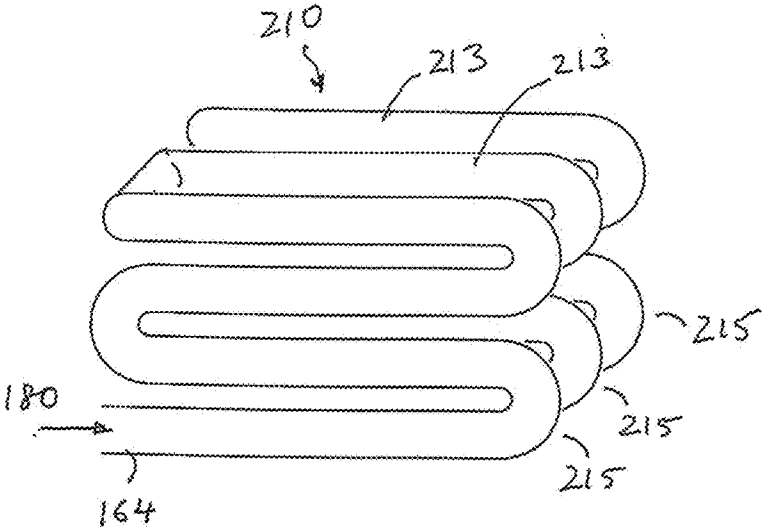
FIG. 4A illustrates a group of interconnected folded structure, according to an embodiment of the present invention.

As seen in FIG. 1, apparatus 200 comprises a media mixer 202 and interaction vessel 210. The media mixer 202 has a first input 161 arranged to receive engineered collection media 174; a second input 162 arranged to receive the slurry 177; and an output 163 arranged to provide a mixture 180 containing slurry 177 and engineered collection media 174. In the mixture 180, there may already be enriched engineered collection media 170 having mineral particles 172 attached thereon. The interaction vessel 210 has an input 164 arranged to receive the mixture 180 and an output 165 to discharge a mixture 181. The interaction vessel 210, as can be seen in FIGS. 3 to 4A, has a compact structure made of pipes or fluid conduits having a continuous flow path from the input to the output. The compact structure provides a long flow path to increase the residence time of the mixture 180 in the interaction vessel while requiring a relatively small footprint. After the mineral particles 172 and the engineered collection media 174 are mixed in the lengthy flow path in the interaction vessel, it is more likely that a large portion of the mineral particles 172 have attached to the engineered collection media 174. Thus, when the mixture 181 is discharged from the output 165, the mixture 181 is rich in enriched engineered collection media 170. The mixture 181 also contains undesirable ore material, or ore residue or tails 179. The discharged mixture 181 from the interaction vessel 210 is received via an input 166 into a media separator 212, wherein the mixture 181 is separated into enriched engineered collection media 170 and tails 179. The tails 179 are discharged from an output 167. The enriched engineered collection media 170 are discharged from an output 168 to a media cleaning unit 214 wherein the mineral particles 172 are stripped off the enriched engineered collection media 170. After stripping, the engineered collection media, barren media or recovered media 174' may be recycled through output 153 back the media mixer 202. The mineral particles 172 are collected through the output 152.

As mentioned above, the interaction vessel 210 has a continous fluid conduit, or pipeline, which is coiled, folded or otherwise shaped into a compact structure to increase the residence time of the mixture 180 within the interaction vessel. The interaction vessel 210 can be made from a part of a fluid conduit or pipeline 199.

As illustrated in FIG. 1, the distance D between the first vessel end 164 and the second vessel end 165 is representative of a footprint of the interaction vessel 210. The total pathlength of the fluid conduit within the interactive vessel 210 is the length of the flow path from the first vessel end 164 and the second vessel end 165. If the total pathlength is 10 times greater than the distance D, the residence time of the mixture 180 within the interaction vessel is increased 10 folds. The increased residence time increases the probability for the mineral particles to attach to the engineered collection media. In the embodiment as shown in FIG. 3, the fluid conduit is coiled into a plurality of loops in order to increase the residence time. In the embodiment as shown in FIG. 4, the fluid conduit is folded into a manifold having a number of folded structures interconnected to provide a continuous flow path in the interaction vessel 210.

Figure 2:
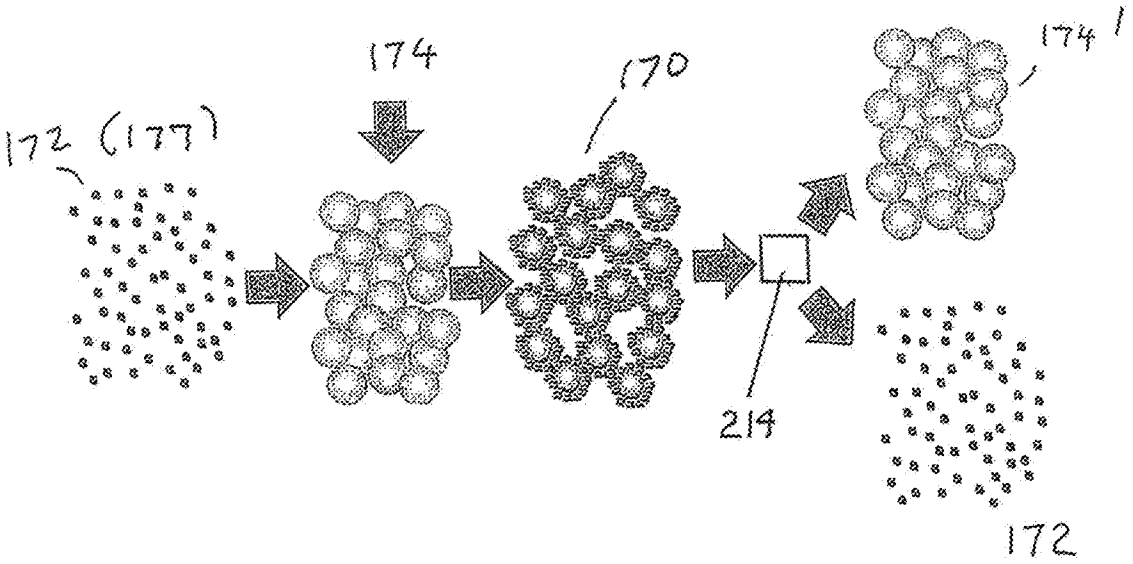
FIG. 2 illustrates the attachment of mineral particles on the synthetic beads and the separation of enriched synthetic beads from undesirable ore material, according to the present invention.

FIG. 2 illustrates the attachment of mineral-bearing ore particles in the slurry onto the engineered collection media and the separation of the enriched engineering collection media into recovered engineered collection media and mineral-bearing ore particles. As seen in FIG. 2, mineral particles 172 contained in the slurry 177 are mixed with hydrophobic media elements or engineered collection media 174 in a mixing chamber such as the media mixer 202 (FIG. 1). In an interaction chamber such as interaction vessel 210, enriched engineered collection media 170 are formed and collected. The enriched engineered collection media 170, after being separated from the ore residue, are directed to a media cleaning unit 214 where the mineral particles 172 are collected and the recovered engineered collection media 174' are separately collected for further processing if needed.

The engineered collection media or 'media elements' act as 'carriers' and collect up the mineral-bearing ore particles in the mixing and interaction vessel through hydrophobic attraction. Media size is chosen to be suitable for subsequent separation from the flow stream using simple mechanical processing, such as screens, and once recovered the media can be cleaned to yield the mineral bearing ore particles of interest, and release the media elements for recycling into the process.

The media-particle mixing and interaction vessel could be a large tank, similar to that of a flotation cell. However, with such a structure, agitation of the internal volume would be required to create sufficient interaction between the media elements and the mineral bearing ore particles; this might require a rotor, or other agitation device to create sufficient internal turbulence in the mix. Consequently, this approach brings no mechanical/energy usage advantage over a traditional flotation cell approach.

When the feed slurry and the media elements are coupled to a pipeline section, the turbulence can be induced into the mix by the natural flow dynamics in the flow stream can provide good mixing kinetics of the slurry and the media without the addition of other mixing devices or energy. The problem, however, is a sufficient 'residence time' is required for good contact/attachment probabilities between the media and the ore particles to be effected, thus requiring a long pipeline section: For example, for a slurry flowing at a rate of 3 m/s, the residence time in a 100 m pipeline section would be 33 sec. Thus, it would take approximately 300 m of pipeline to achieve a 100 second (approx. 1.6 minute) residence time typical of that used in conventional rougher stage flotation cells.

This pipeline section could be accommodated in a minerals processing plant by a linear out-and-back path of 150 m, or the pipeline section could be coiled up, as illustrated in FIG. 3 to form a compact footprint. If the pipeline section is coiled on a diameter of 10 m, this system would necessitate a stack of 10 loops, requiring a footprint comparable to standard flotation cells.

FIG. 3 illustrates an interaction vessel, according to an embodiment of the present invention. As seen in FIG. 3, a pipe or fluid conduit is coiled into a coiled structure having a plurality of loops 211 placed one on top of another. The loops 211 can be circular or elliptical. If the loops 211 are circular, then the distance D is substantially equal to the diameter of the loops 211. If the loops are elliptical, then the distance D can be a half of the semi-major axis, for example. If the coiled structure has 8 loops and the loops are circular, then the flow pathlength of the fluid conduit in the interaction vessel 210 is about 24 D. This means the residence time of the mixture 180 in the coiled structure is about 24 times longer than the residence time in a pipeline section having a length of D. It should be noted that the number of loops can be as small as one or two and also can be ten, twenty or more. If there are only two loops, than the distance D is about 6 times smaller than the flow pathlength.

In the embodiment as shown in FIG. 4, a slurry feed from the classifiers is feed to a mixing manifold where the slurry is mixed with media. The mixture is than moved through an interaction vessel made of a matrix of pipes or pipe sections. For example, a 10×10 matrix of pipes provides 100 fold improvement in the effective 'interaction pipeline length' for a given linear footprint. Here the pipes could be 'folded' between the manifolds to increase the flow pathlength. This type of format would potentially allow the comparable interaction volume to that of flotation cells for an even smaller footprint.

As seen in FIG. 4, the interaction vessel 210 is made from a plurality of pipe or fluid conduit segments 213. These conduit segments can be connected in many different ways to become one or more manifolds. The length of the conduit segments 213 is substantially equal to the distance D of the interaction vessel as shown in FIG. 1. In the embodiment as shown in FIG. 4, the interaction vessel 210 is integrated with the media mixer 201 (see FIG. 1). The interaction vessel 210 is also linked to a collection manifold 204 which is arranged to provide the mixture 181 through the output 166. In an embodiment of the present invention, the pipe or conduit segments 213 are folded into a plurality of folded structures 215, as shown in FIG. 4A. As illustrated in FIG. 4A, the interaction vessel 210 or the overall manifold has 3 folded structures 215. Each folded structure 215 is made from 4 conduit segments 213. Thus, this interaction vessel comprises a 3×4 matrix of conduct segments. The folded structures 215 can be interconnected to provide a continuous flow path of 12 times the length of each conduct segment. Thus, the residence time for the mixture 180 in the overall manifold is about 12 times the residence time in a pipeline section having a length of D. It should be noted that the number of pipe or conduit sections can be smaller or larger.

Figure 4B:
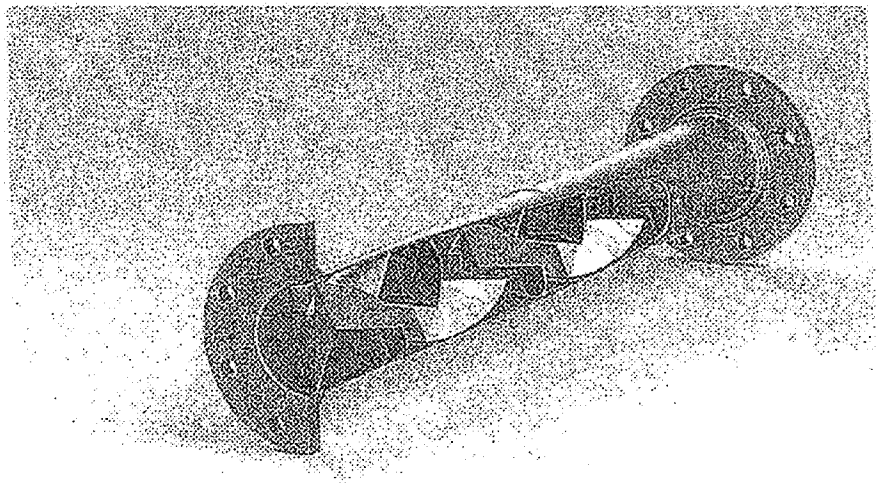
FIG. 4B illustrates a static mixer pipe, according to an embodiment of the present invention.

The fluid kinetics of both embodiments shown in FIGS. 3 and 4 could be modified by deploying a static mixing section of pipe as shown in FIG. 4B. The static mixer would increase kinetics which in turn could reduce the length of pipe required. The kinetics within the pipe could be tailored by the design of the mixing insert. In an embodiment of the present invention, the static mixer comprises a path extending structure therein for increasing the fluid path in the conduit segment.

As indicated in FIG. 1, following the pipeline mixer section, the media is extracted from the slurry mix using a mechanical screen to extract the (large) media elements. The media is then transferred to a 'cleaning stage' where the mineral bearing ore particles are released from the media, and the media elements can be recovered and recycled for re-use in the process. This cleaning step can be achieved via a number of methods including chemical (solvent or pH), or mechanical agitation (including ultrasonic).

Figure 8:
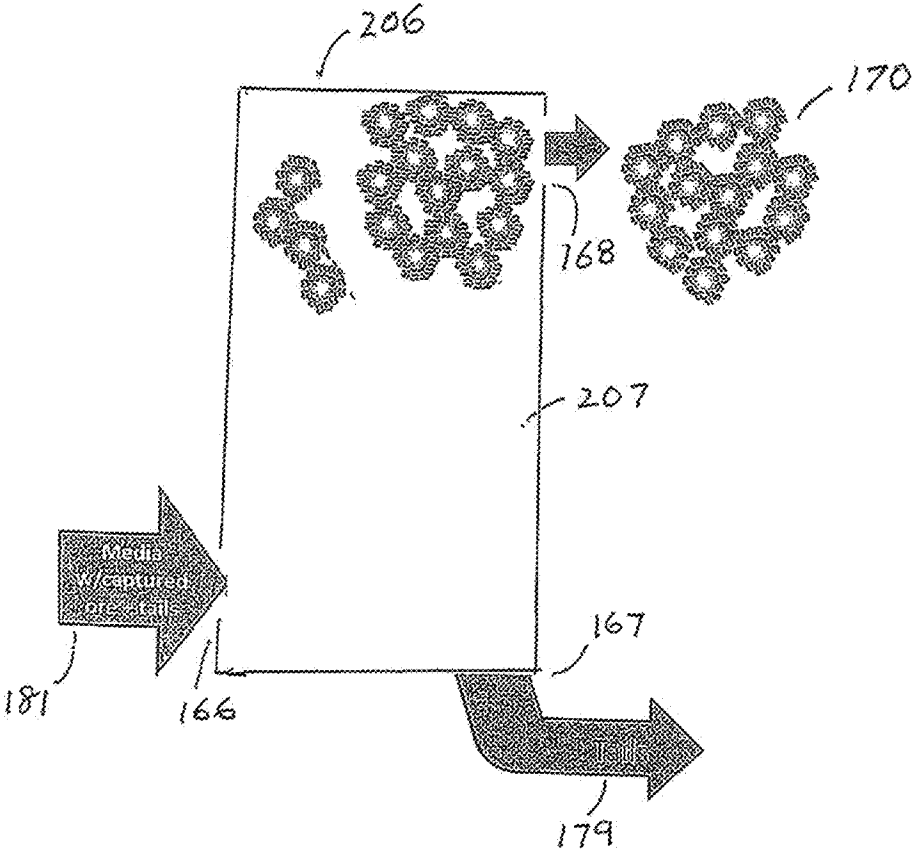
FIG. 8 illustrates a flotation chamber, according to an embodiment of the present invention.

The above system describes the use of mechanical separation of the mineral-bearing ore particle laden media (e.g., size based screening). There are many alternatives to this media extraction: For example, following the pipeline mixer, a form of "flash float" could be used to rapidly remove the media elements if they are buoyant: In this case, either hollow media or media fabricated of a material to provide an effective SG (specific gravity)<1 for the 'laden' media elements (effective SG for the media once laden with mineral bearing ore). Foam-based core materials could be a good option (see FIG. 6*e*). An example of "flash float" configuration is shown in FIG. 8.

FIGS. 5*a*, 5*b*, 6*a*-6*e* and 7*a*-7*d*

Figure 5B:
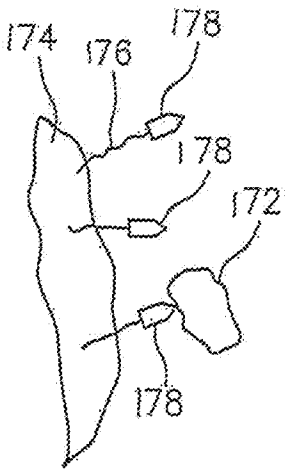
FIG. 5*b* illustrates part of a loaded bead having molecules to attract mineral particles.
Figure 5A:
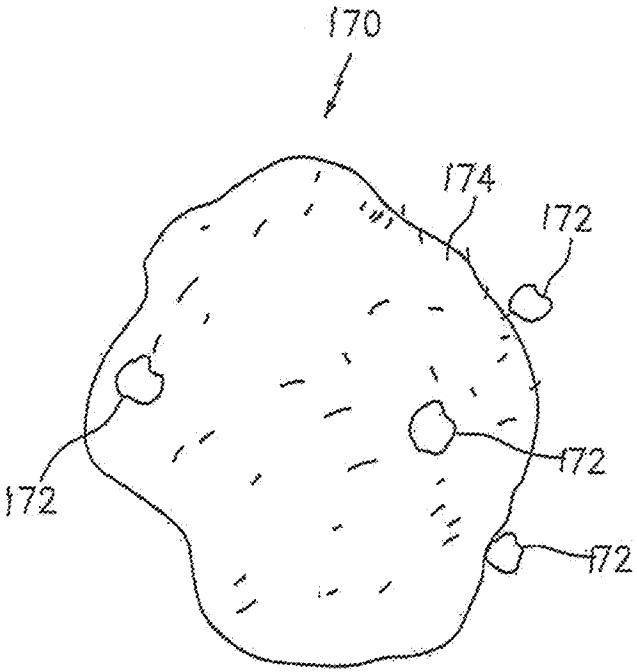
FIG. 5*a* illustrates a mineral laden synthetic bead, or loaded bead.

FIG. 5*a* illustrates a mineral laden synthetic bead, or loaded bead 170. As illustrated, a synthetic bead 174 can attract many mineral particles 172. FIG. 5*b* illustrates part of a loaded bead having molecules (176, 178) to attract mineral particles.

As shown in FIGS. 5*a* and 5*b*, the synthetic bead 174 has a bead body to provide a bead surface. At least the outside part of the bead body is made of a synthetic material, such as polymer, so as to provide a plurality of molecules or molecular segments 176 on the surface of the bead 174. The molecule 176 is used to attach a chemical functional group 178 to the surface of bead 174. In general, the molecule 176 can be a hydrocarbon chain, for example, and the functional group 178 can have an anionic bond for attracting or attaching a mineral, such as copper to the surface. A xanthate, for example, has both the functional group 178 and the molecular segment 176 to be incorporated into the polymer that is used to make the synthetic bead 174. A functional group 178 is also known as a collector that is either ionic or non-ionic. The ion can be anionic or cationic. An anion includes oxyhydryl, such as carboxylic, sulfates and sulfonates, and sulfhydryl, such as xanthates and dithiophosphates. Other molecules or compounds that can be used to provide the function group 178 include, but are not limited to, thionocarboamates, thioureas, xanthogens, monothiophosphates, hydroquinones and polyamines. Similarly, a chelating agent can be incorporated into or onto the polymer as a collector site for attracting a mineral particle. As shown in FIG. 5*b*, a mineral particle 172 is attached to the functional group 178 on a molecule 176. In general, the mineral particle 172 is much smaller than the synthetic bead 174. Many mineral particles 172 can be attracted to or attached to the surface of a synthetic bead 174.

Figure 6A:
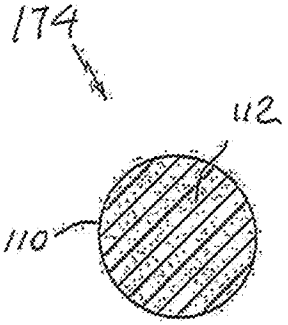
FIGS. 6*a*-6*e* illustrate a synthetic bead with different shapes and structures.
Figure 6B:
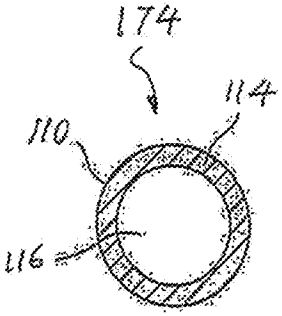
Figure 6C:
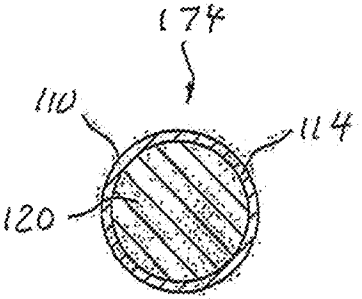

In some embodiments of the present invention, a synthetic bead has a solid-phase body made of a synthetic material, such as polymer. The polymer can be rigid or elastomeric. An elastomeric polymer can be polyisoprene or polybutadiene, for example. The synthetic bead 174 has a bead body 110 having a surface comprising a plurality of molecules with one or more functional groups for attracting mineral particles to the surface. A polymer having a functional group to collect mineral particles is referred to as a functionalized polymer. In one embodiment, the entire interior part 112 of the body 110 of the synthetic bead 174 is made of the same functionalized material, as shown in FIG. 6*a*. In another embodiment, the bead body 110 comprises a shell 114. The shell 114 can be formed by way of expansion, such as thermal expansion or pressure reduction. The shell 114 can be a micro-bubble or a balloon. In FIG. 6*b*, the shell 114, which is made of functionalized material, has an interior part 116. The interior part 116 can be filled with air or gas to aid buoyancy, for example. The interior part 116 can be used to contain a liquid to be released during the mineral separation process. The encapsulated liquid can be a polar liquid or a non-polar liquid, for example. The encapsulated liquid can contain a depressant composition for the enhanced separation of copper, nickel, zinc, lead in sulfide ores in the flotation stage, for example. The shell 114 can be used to encapsulate a powder which can have a magnetic property so as to cause the synthetic bead to be magnetic, for example. The encapsulated liquid or powder may contain monomers, oligomers or short polymer segments for wetting the surface of mineral particles when released from the beads. For example, each of the monomers or oligomers may contain one functional group for attaching to a mineral particle and an ion for attaching the wetted mineral particle to the synthetic bead. The shell 84 can be used to encapsulate a solid core, such as Styrofoam to aid buoyancy, for example. In yet another embodiment, only the coating of the bead body is made of functionalized polymer. As shown in FIG. 6*c*, the synthetic bead has a core 120 made of ceramic, glass or metal and only the surface of core 120 has a coating or shell 114 made of functionalized polymer. The core 120 can be a hollow core or a filled core depending on the application. The core 120 can be a micro-bubble, a sphere or balloon. For example, a filled core made of metal makes the density of the synthetic bead to be higher than the density of the pulp slurry, for example. The core 120 can be made of a magnetic material so that the para-, ferri-, ferro-magnetism of the synthetic bead is greater than the para-, ferri-, ferro-magnetism of the unwanted ground ore particle in the mixture. In a different embodiment, the synthetic bead can be configured with a ferro-magnetic or ferri-magnetic core that attract to paramagnetic surfaces. A core 120 made of glass or ceramic can be used to make the density of the synthetic bead substantially equal to the density of the pulp slurry so that when the synthetic beads are mixed into the pulp slurry for mineral collection, the beads can be in a suspension state.

Figure 6D:
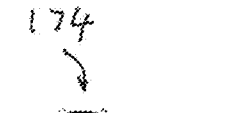
Figure 6E:
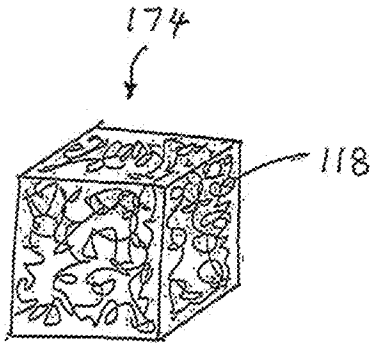

According to a different embodiment of the present invention, the synthetic bead 174 can be a porous block 117 or take the form of a sponge or foam with multiple segregated gas filled chambers as shown in FIGS. 6*d* and 6*e*. FIG. 6*e* illustrates a synthetic bead 174 made from a foam block 118. The foam block 118 can be made of an open-cell foam.

It should be understood that the term "bead" does not limit the shape of the synthetic bead of the present invention to be spherical, as shown in FIGS. 6*a*-6*d*. In some embodiments of the present invention, the synthetic bead 174 can have an elliptical shape, a cylindrical shape, a shape of a block. Furthermore, the synthetic bead can have an irregular shape.

Figure 7A:
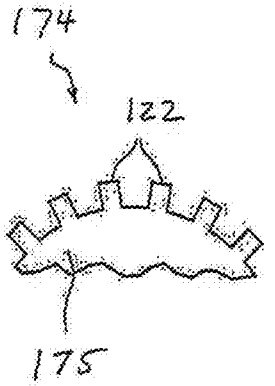
FIGS. 7*a*-7*d* illustrate various surface features on a synthetic bead to increase the collection area.
Figure 7B:
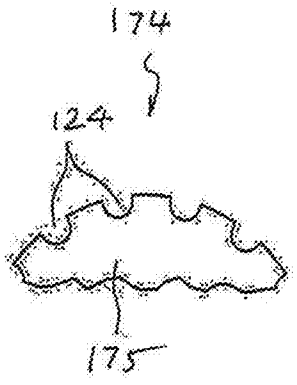
Figure 7C:
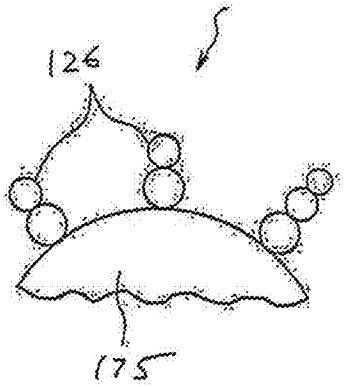
Figure 7D:
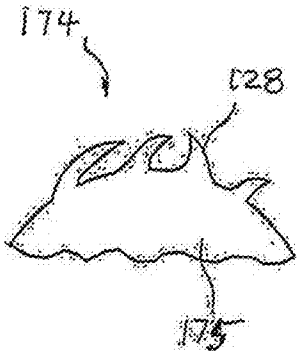

It should also be understood that the surface of a synthetic bead, according to the present invention, is not limited to an overall smooth surface as shown in FIGS. 6*a*-6*e*. In some embodiments of the present invention, the surface can be irregular and rough. For example, the surface 175 of the bead 174 can have some physical structures 122 like grooves or rods as shown in FIG. 7*a*. The surface 175 of bead 174 can have some physical structures 124 like holes or dents as shown in FIG. 7*b*. The surface 175 of bead 174 can have some physical structures 126 formed from stacked beads as shown in FIG. 7*c*. The surface 174 can have some hair-like physical structures 128 as shown in FIG. 7*d*. In addition to the functional groups on the synthetic beads that attract mineral particles to the bead surface, the physical structures can help trapping the mineral particles on the bead surface. The surface of bead 174 can be configured to be a honeycomb surface or sponge-like surface for trapping the mineral particles and/or increasing the contacting surface.

It should also be noted that the synthetic beads of the present invention can be realized by a different way to achieve the same goal. Namely, it is possible to use a different means to attract the mineral particles to the surface of the synthetic beads. For example, the surface of the polymer beads, shells can be functionalized with a hydrophobic chemical molecule or compound. The synthetic beads and/or engineered collection media can be made of a polymer. The term "polymer" in this specification means a large molecule made of many units of the same or similar structure linked together. Furthermore, the polymer can be naturally hydrophobic or functionalized to be hydrophobic. Some polymers having a long hydrocarbon chain or silicon-oxygen backbone, for example, tend to be hydrophobic. Hydrophobic polymers include polystyrene, poly(d,l-lactide), poly(dimethylsiloxane), polypropylene, polyacrylic, polyethylene, etc. The bubbles or beads, such as synthetic bead 174 can be made of glass to be coated with hydrophobic silicone polymer including polysiloxanates so that the bubbles or beads become hydrophobic. The bubbles or beads can be made of metal to be coated with silicone alkyd copolymer, for example, so as to render the bubbles or beads hydrophobic. The bubbles or beads can be made of ceramic to be coated with fluoroalkylsilane, for example, so as to render the bubbles and beads hydrophobic. The bubbles or beads can be made of hydrophobic polymers, such as polystyrene and polypropylene to provide a hydrophobic surface. The wetted mineral particles attached to the hydrophobic synthetic bubble or beads can be released thermally, ultrasonically, electromagnetically, mechanically or in a low pH environment.

The multiplicity of hollow objects, bodies, elements or structures may include hollow cylinders or spheres, as well as capillary tubes, or some combination thereof. The scope of the invention is not intended to be limited to the type, kind or geometric shape of the hollow object, body, element or structure or the uniformity of the mixture of the same.

In general, the mineral processing industry has used flotation as a means of recovering valuable minerals. This process uses small air bubbles injected into a cell containing the mineral and slurry whereby the mineral attaches to the bubble and is floated to the surface. This process leads to separating the desired mineral from the gangue material. Alternatives to air bubbles have been proposed where small spheres with proprietary polymer coatings are instead used. This disclosure proposes a new and novel media type with a number of advantages.

One disadvantage of spherical shaped recovery media such as a bubble, is that it possesses a poor surface area to volume ratio. Surface area is an important property in the mineral recovery process because it defines the amount of mass that can be captured and recovered. High surface area to volume ratios allows higher recovery per unit volume of media added to a cell. As illustrated in FIG. 8*e*, open-cell foam and sponge-like material can be as engineered collection media. Open cell or reticulated foam offers an advantage over other media shapes such as the sphere by having higher surface area to volume ration. Applying a functionalized polymer coating that promotes attachment of mineral to the foam "network" enables higher recovery rates and improved recovery of less liberated mineral when compared to the conventional process. For example, open cells allow passage of fluid and particles smaller than the cell size but capture mineral bearing particles that come in contact with the functionalized polymer coating. Selection of cell size is dependent upon slurry properties and application.

The coated foam may be cut in a variety of shapes and forms. For example, a polymer coated foam belt can be moved through the slurry to collect the desired minerals and then cleaned to remove the collected desired minerals. The cleaned foam belt can be reintroduced into the slurry. Strips, blocks, and/or sheets of coated foam of varying size can also be used where they are randomly mixed along with the slurry in a mixing cell. The thickness and cell size of a foam can be dimensioned to be used as a cartridge-like filter which can be removed, cleaned of recovered mineral, and reused.

As mentioned earlier, the open cell or reticulated foam, when coated or soaked with hydrophobic chemical, offers an advantage over other media shapes such as sphere by having higher surface area to volume ratio. Surface area is an important property in the mineral recovery process because it defines the amount of mass that can be captured and recovered. High surface area to volume ratios allows higher recovery per unit volume of media added to a cell.

The open cell or reticulated foam provides functionalized three dimensional open network structures having high surface area with extensive interior surfaces and tortuous paths protected from abrasion and premature release of attached mineral particles. This provides for enhanced collection and increased functional durability. Spherical shaped recovery media, such as beads, and also of belts, and filters, is poor surface area to volume ratio—these media do not provide high surface area for maximum collection of mineral. Furthermore, certain media such as beads, belts and filters may be subject to rapid degradation of functionality.

Applying a functionalized polymer coating that promotes attachment of mineral to the foam "network" enables higher recovery rates and improved recovery of less liberated mineral when compared to the conventional process. This foam is open cell so it allows passage of fluid and particles smaller than the cell size but captures mineral bearing particles that come in contact with the functionalized polymer coating. Selection of cell size is dependent upon slurry properties and application.

A three-dimensional open cellular structure optimized to provide a compliant, tacky surface of low energy enhances collection of hydrophobic or hydrophobized mineral particles ranging widely in particle size. This structure may be comprised of open-cell foam coated with a compliant, tacky polymer of low surface energy. The foam may be comprised of reticulated polyurethane or another appropriate open-cell foam material such as silicone, polychloroprene, polyisocyanurate, polystyrene, polyolefin, polyvinylchloride, epoxy, latex, fluoropolymer, phenolic, EPDM, nitrile, composite foams and such. The coating may be a polysiloxane derivative such as polydimethylsiloxane and may be modified with tackifiers, plasticizers, crosslinking agents, chain transfer agents, chain extenders, adhesion promoters, aryl or alky copolymers, fluorinated copolymers, hydrophobizing agents such as hexamethyldisilazane, and/or inorganic particles such as silica or hydrophobic silica. Alternatively, the coating may be comprised of materials typically known as pressure sensitive adhesives, e.g. acrylics, butyl rubber, ethylene vinyl acetate, natural rubber, nitriles; styrene block copolymers with ethylene, propylene, and isoprene; polyurethanes, and polyvinyl ethers as long as they are formulated to be compliant and tacky with low surface energy.

The three-dimensional open cellular structure may be coated with a primer or other adhesion agent to promote adhesion of the outer collection coating to the underlying structure.

In addition to soft polymeric foams, other three-dimensional open cellular structures such as hard plastics, ceramics, carbon fiber, and metals may be used. Examples include metal and ceramic foams and porous hard plastics such as polypropylene honeycombs and such. These structures must be similarly optimized to provide a compliant, tacky surface of low energy by coating as above.

The three-dimensional, open cellular structures above may be coated or may be directly reacted to form a compliant, tacky surface of low energy.

The three-dimensional, open cellular structure may itself form a compliant, tacky surface of low energy by, for example, forming such a structure directly from the coating polymers as described above. This is accomplished through methods of forming open-cell polymeric foams known to the art.

The structure may be in the form of sheets, cubes, spheres, or other shapes as well as densities (described by pores per inch and pore size distribution), and levels of tortuosity that optimize surface access, surface area, mineral attachment/detachment kinetics, and durability. These structures may be additionally optimized to target certain mineral particle size ranges, with denser structures acquiring smaller particle sizes. In general, cellular densities may range from 10-200 pores per inch, more preferably 30-90 pores per inch, and most preferably 30-60 pores per inch.

The specific shape or form of the structure may be selected for optimum performance for a specific application. For example, the structure (coated foam for example) may be cut in a variety of shapes and forms. For example, a polymer coated foam belt could be moved through the slurry removing the desired mineral whereby it is cleaned and reintroduced into the slurry. Strips, blocks, and/or sheets of coated foam of varying size could also be used where they are randomly mixed along with the slurry in a mixing cell. Alternatively, a conveyor structure may be formed where the foam is encased in a cage structure that allows a mineral-containing slurry to pass through the cage structure to be introduced to the underlying foam structure where the mineral can react with the foam and thereafter be further processed in accordance with the present invention. The thickness and cell size could be changed to a form cartridge like filter whereby the filter is removed, cleaned of recovered mineral, and reused.

FIG. 8

According to an embodiment of the present invention, a flotation column 206 has an input 166 arranged to receive the mixture 181 into a column or chamber 207. With the engineered collection media being made of a low-density material or having a bead structure with empty core, the laden media or enriched engineered collection media 170 would float to the top portion of the chamber 207. The laden media 170 can then be discharged through the output 168, while the ore residue or tails 179 can be discharged through output 167. In the flotation column 206, mechanical stirrers can be used to facitate the separation of laden media 170 and the ore residue 179, for example.

The Related Family

This application is also related to a family of nine PCT applications, which were all concurrently filed on 25 May 2012, as follows:

PCT application no. PCT/US12/39528, entitled "Flotation separation using lightweight synthetic bubbles and beads;"

PCT application no. PCT/US12/39524, entitled "Mineral separation using functionalized polymer membranes;"

PCT application no. PCT/US12/39540, entitled "Mineral separation using sized, weighted and magnetized beads;"

PCT application no. PCT/US12/39576, entitled "Synthetic bubbles/beads functionalized with molecules for attracting or attaching to mineral particles of interest," which corresponds to U.S. Pat. No. 9,352,335;

PCT application no. PCT/US12/39591, entitled "Method and system for releasing mineral from synthetic bubbles and beads;"

PCT application no. PCT/US/39596, entitled "Synthetic bubbles and beads having hydrophobic surface;"

PCT application no. PCT/US/39631, entitled "Mineral separation using functionalized filters and membranes," which corresponds to U.S. Pat. No. 9,302,270;

PCT application no. PCT/US12/39655, entitled "Mineral recovery in tailings using functionalized polymers;" and PCT application no. PCT/US12/39658, entitled "Techniques for transporting synthetic beads or bubbles In a flotation cell or column," all of which are incorporated by reference in their entirety.

This application also related to PCT application no. PCT/US2013/042202, filed 22 May 2013, entitled "Charged engineered polymer beads/bubbles functionalized with molecules for attracting and attaching to mineral particles of interest for flotation separation," which claims the benefit of U.S. Provisional Patent Application No. 61/650,210, filed 22 May 2012, which is incorporated by reference herein in its entirety.

This application is also related to PCT/US2014/037823, filed 13 May 2014, entitled "Polymer surfaces having a siloxane functional group," which claims benefit to U.S. Provisional Patent Application No. 61/822,679, filed 13 May 2013, as well as U.S. patent application Ser. No. 14/118,984, filed 27 Jan. 2014, and is a continuation-in-part to PCT application no. PCT/US12/39631 (712-2.385//CCS-0092), filed 25 May 2012, which are all hereby incorporated by reference in their entirety.

This application also related to PCT application no. PCT/US13/28303, filed 28 Feb. 2013, entitled "Method and system for flotation separation in a magnetically controllable and steerable foam," which is also hereby incorporated by reference in its entirety.

This application also related to PCT application no. PCT/US16/57334, filed 17 Oct. 2016, entitled "Opportunities for recovery augmentation process as applied to molybdenum production," which is also hereby incorporated by reference in its entirety.

This application also related to PCT application no. PCT/US16/37322, filed 17 Oct. 2016, entitled "Mineral beneficiation utilizing engineered materials for mineral separation and coarse particle recovery," which is also hereby incorporated by reference in its entirety.

This application also related to PCT application no. PCT/US16/62242, filed 16 Nov. 2016, entitled "Utilizing engineered media for recovery of minerals in tailings stream at the end of a flotation separation process," which is also hereby incorporated by reference in its entirety.

THE SCOPE OF THE INVENTION

It should be further appreciated that any of the features, characteristics, alternatives or modifications described regarding a particular embodiment herein may also be applied, used, or incorporated with any other embodiment described herein. In addition, it is contemplated that, while the embodiments described herein are useful for homogeneous flows, the embodiments described herein can also be used for dispersive flows having dispersive properties (e.g., stratified flow).

Although the invention has been described and illustrated with respect to exemplary embodiments thereof, the foregoing and various other additions and omissions may be made therein and thereto without departing from the spirit and scope of the present invention.

What is claimed is:

1. An apparatus, comprising:

a plurality of synthetic beads; and a fluid conduit arranged to receive a mixture of slurry to be mixed with the plurality of synthetic beads, the slurry comprising mineral particles and undesirable ore material, the fluid conduit also arranged to discharge enriched synthetic beads having mineral particles attached thereon, the synthetic beads having a surface functionalized with a hydrophobic material, wherein at least part of the fluid conduit is shaped into an interaction vessel, wherein a fluid path is defined by and is substantially equal to the length of said fluid conduit in said interaction vessel and the interaction vessel having a first vessel end errand a second vessel end, and wherein a distance between the first vessel end and the second vessel end is at least 6 times smaller than the fluid path in the fluid conduit in the interaction vessel.

2. The apparatus according to claim 1, wherein said part of fluid conduit is coiled into a plurality of loops, said plurality of loops comprises n loop, with n being a positive number greater 2.

3. The apparatus according to claim 2, wherein n=8 or greater.

4. The apparatus according to claim 2, wherein said plurality of loops comprises continuous loops placed one on top of another.

5. The apparatus according to claim 2, wherein said plurality of loops comprises circular or elliptical loops.

6. The apparatus according to claim 5, wherein each of the circular loops has a diameter substantially equal to the distance between the first vessel end and the second vessel end.

7. The apparatus according to claim 5, wherein each of the elliptical loops has a semi-miner axis and a semi-major axis, the semi-major axis is substantially equal to half of the distance between the first vessel end and the second vessel end.

8. The apparatus according to claim 1, wherein said part of fluid conduit is folded into n folded structures, each folded structure comprising m conduit segments interconnected to provide a continuous path therein, each conduit segment having a segment length substantially equal to the distance between the first vessel end and the second vessel end, wherein n and m are positive numbers with n×m being greater than 6.

9. The apparatus according to claim 8, wherein n is equal to 10 or greater, and m is equal to 10 or greater.

10. The apparatus according to claim 8, wherein at least some of the conduit segments comprises a path extending structure therein for increasing the fluid path in the conduit segment.

11. The apparatus according to claim 1, further comprising a mixing chamber, the mixing chamber comprising a first input arranged to receive the slurry;

a second input arranged to receive the synthetic beads, and an output arranged to provide the mixture of the slurry and synthetic beads to the first conduit end of the fluid conduit.

12. The apparatus according to claim 1, wherein the second conduit end is further arranged to discharge the undesirable ore material in the slurry, said apparatus further comprising a separation device, the separation device having an input, a first output and a second output, the input arranged to receive a mixed material comprising the enriched synthetic beads having mineral particles attached thereon and the undesirable ore material, the separation device configured to separate the mixed material into a first separated part and a second separation part, wherein the first output is arranged to discharge the first separated part and the second output arranged to discharge the second separated part, wherein the first separated part comprises the enriched synthetic beads having mineral particles attached thereon, and the second separated part comprises the undesirable ore material.

13. The apparatus according to claim 12, wherein the synthetic beads are buoyant as to water, and wherein the separation device comprises a flotation chamber having a lower part and an upper part, the lower part arranged to receive the mixed material and the upper part arranged to gather the enriched synthetic beads having mineral particles attached thereon for providing the first separated part.

14. The apparatus according to claim 1, wherein the hydrophobic material is selected from the group consisting of polysiloxanes, poly(dimethylsiloxane), hydrophobically-modified ethyl hydroxyethyl cellulose, polysiloxanates, alkylsilane and fluoroalkylsilane.

15. The apparatus according to claim 14, wherein the synthetic beads are made of an open-cell foam.

16. The apparatus according to claim 14, wherein the synthetic beads have a substantially spherical shape.

17. The apparatus according to claim 14, wherein the synthetic beads have a substantially cubic shape.

* * * * *